United States Patent [19]

Saunders

[11] Patent Number: 4,726,348

[45] Date of Patent: Feb. 23, 1988

[54] STRING TRACKING MECHANISM FOR A BOW AND ARROW

[76] Inventor: Charles A. Saunders, 8380 36th Ave., Columbus, Nebr. 68601

[21] Appl. No.: 897,436

[22] Filed: Aug. 18, 1986

Related U.S. Application Data

[63] Continuation of Ser. No. 714,706, Mar. 21, 1985, abandoned.

[51] Int. Cl.[4] ..... F41B 5/00

[52] U.S. Cl. ..... 124/24 R; 124/88

[58] Field of Search ..... 124/23 R, 24 R, 80, 124/86, 88, 89

[56] References Cited

U.S. PATENT DOCUMENTS

| | | | |
|---|---|---|---|
| 736,051 | 8/1903 | Adams | 124/88 |
| 2,918,049 | 12/1959 | Stockfleth | 124/88 |
| 3,216,670 | 11/1965 | Neumiller | 124/24 R |
| 4,024,667 | 5/1977 | Wegener | 124/24 R |
| 4,417,403 | 11/1983 | Strange | 124/87 |

OTHER PUBLICATIONS

Bow & Arrow Publication, The Game Tracker Advertizement, Jun. 1982, p 41.

*Primary Examiner*—Richard C. Pinkham
*Assistant Examiner*—Benjamin Layno
*Attorney, Agent, or Firm*—Henderson & Sturm

[57] ABSTRACT

An attachment for a string tracking apparatus for a bow and arrow of a type having a container of string with one end thereof attached to an arrow nocked onto the string of such bow. The string tracking apparatus is utilized to cause the end of the string to follow the flight of the arrow so that a bow hunter can find the arrow, or game which has been penetrated by the arrow, by merely following the string leading thereto. A clip is attached to the handle of the bow at a position adjacent to the arrow for holding the portion of the string, which has been unwound from the container, adjacent to the arrow and adjacent to the bow handle to minimize the risk that the string will get caught on a branch or otherwise permit more than a desired amount of string to flow from the container prior to shooting the arrow from the bow.

4 Claims, 6 Drawing Figures

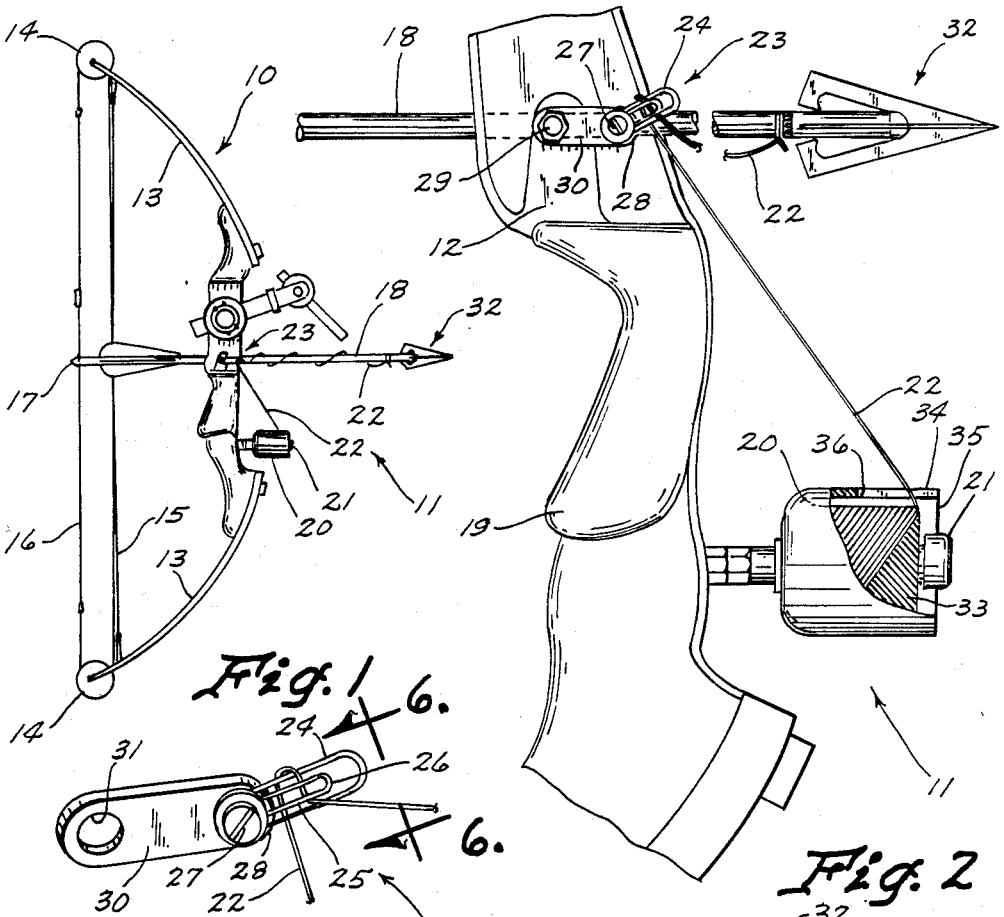
Fig. 1
Fig. 2
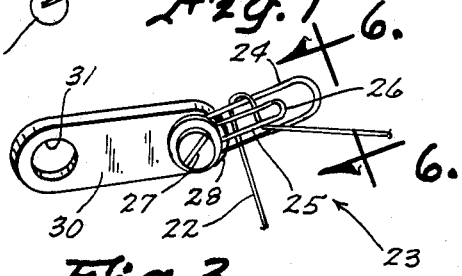
Fig. 3
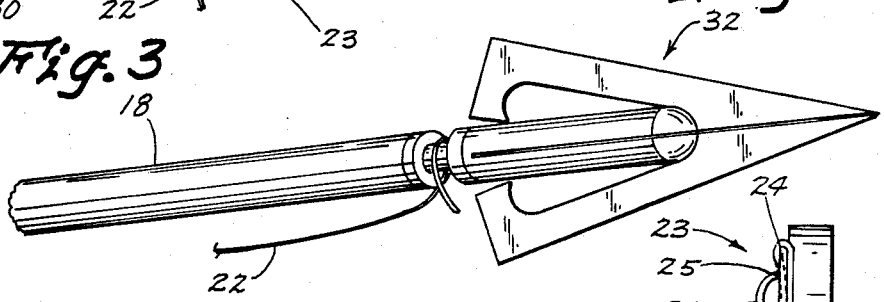
Fig. 4
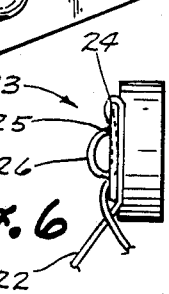
Fig. 6
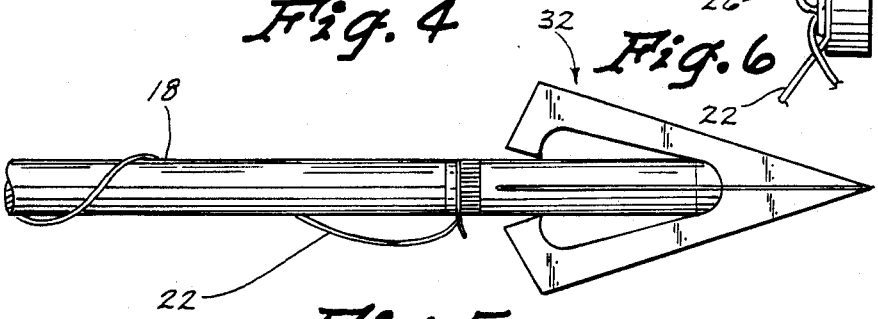
Fig. 5

STRING TRACKING MECHANISM FOR A BOW AND ARROW

This is a continuation of co-pending application Ser. No. 06/714,706 filed on Mar. 21, 1985 and since abandoned.

TECHNICAL FIELD

The present invention relates generally to bow hunting equipment and more particularly to an attachment to a string tracking apparatus for a hunting bow and arrow.

BACKGROUND ART

When hunting wild game with a bow and arrow and a fatal hit is made upon such game, more often than not, the game retreat out of the sight of the bow hunter before it expires. Under such circumstances, a bow hunter typically follows a blood trail left by the fatally hit game until the animal is found. From time to time, however, there will be little or no blood trail to follow. This can be caused by an arrow plugging up a wound, or for many other reasons. Another problem can be that rain will wash away a blood trail or snow will cover it. This problem is a major one especially when hunting wild turkeys because they very rarely leave a good blood trail. This is due in part to the fact that the feathers stop the blood flow; and, secondarily, to the fact that turkeys do not contain as much blood as do larger animals, such as deer.

For the aforementioned reasons, string tracking devices have been devised for attachment to a bow and arrow whereby a large quantity of string in some kind of a container is attached to the bow handle. One end of the string is attached to the arrow so that when the arrow is shot from the bow, the string will follow the arrow. Then as the animal retreats, the string will unwind from the container and the bow hunter merely needs to follow the string to find the game shot by the arrow.

One of the problems with prior art string tracking attachments is that the string hangs down loosely from the arrow to the container holding the string, and sometimes unwinds due to such loose condition. Another major problem with this loose string is that as a bow hunter moves through the woods, concentrating on trying to find game, the loose string often catches on a branch or the like, causing the string to become unwound prematurely and render the string tracker inoperable until and unless the string is rewound onto the spool, or the excess string is cut off and an appropriate length of string between the string tracking container and where it attaches to the arrow is again utilized.

DISCLOSURE OF THE INVENTION

The present invention relates to an attachment for a string tracking apparatus for a bow and arrow. A container of string having one end thereof attached to an arrow nocked onto the string of such bow is utilized to cause the end of the string to follow the flight of the arrow so that a bow hunter can find the arrow, or game which has been penetrated by the arrow, by merely following the string leading thereto. A clip is attached to the handle of the bow at a position adjacent to the arrow for holding the portion cf the string, which has been unwound from the container, adjacent to the arrow and adjacent to the bow handle to minimize the risk that the string will get caught on a branch or otherwise permit more than a desired amount of string to flow from the container prior to shooting the arrow from the bow.

An object of the present invention is to provide an improved string tracking apparatus.

Another object of the invention is to provide an attachment for a string tracking apparatus which will hold the portion of the string which is unwound from the container close to the arrow and close to the bow handle to minimize the risk that the string be caught on a branch or otherwise prematurely permitting excess amounts of string to flow from the string tracking apparatus.

Other objects, advantages, and novel features of the present invention will become apparent from the following detailed description of the invention when considered in conjunction with the accompanying drawings.

BRIEF DESCRIPTION OF THE DRAWINGS

FIG. 1 shows a side elevational view of a bow and arrow having a string tracking apparatus constructed in accordance with the present invention attached thereto;

FIG. 2 is an enlarged side elevational view of the string tracking apparatus constructed in accordance with the present invention with a portion of the bow, arrow and string tracking apparatus broken away to show the essential parts only thereof;

FIG. 3 is an enlarged perspective view of an attachment for a string tracking apparatus constructed in accordance with the present invention and having the string attached thereto in a preferred position;

FIG. 4 is an enlarged partial perspective view of the end of the arrow, showing how the string is wrapped around the end thereof;

FIG. 5 is a view like FIG. 4 but showing how the broadhead is threadably tightened down upon the string to attach it to the arrow; and FIG. 6 is a view of the string holding clip taken along line 6—6 of FIG. 3.

BEST MODE FOR CARRYING OUT THE INVENTION

Referring now to the drawings, wherein like reference numerals designate identical or corresponding parts throughout the several views, FIG. 1 shows a compound bow (10) having the string tracking apparatus constructed in accordance with the present invention (11) attached thereto. The bow (10) is of a conventional compound type, but it is to be understood that any type of a bow could have a string tracking apparatus (11) attached thereto. This particular bow (10), has a handle (12) which has limbs (13) attached thereto, and the limbs (13) have eccentrically mounted wheels (14) rotatably disposed on each end thereof. Conventional cables (15) extend over the wheels (14) and the ends of the cable are attached to a string (16), having a nocking point (17) thereon. An arrow (18) is nocked onto the nocking point (17) of the string (16) and the arrow is held in the position shown in FIG. 1 by an arrow rest (not shown) disposed on the other side of the handle from the side shown in FIGS. 1 and 2.

A majority of commercially produced bows today have a threaded opening on the back side of the handle, just below the hand grip (19) thereof for threadably attaching a threaded stabilizer shaft thereto. A housing (20) and spindle (21) have a threaded shaft threadably connected to the bow handle (12) at the aforementioned position. A large quantity of string (33) is wound around the outside of a spool on the spindle (21), and an end portion (22) thereof extends upwardly through a slot (34) extending from the surface (35) to the end (36) of the slot (34) to a clip attachment (23), as can best be seen in FIGS. 2 and 3. This clip attachment (23) includes a conventional paper clip-type of structure, constructed of one piece of wire and having an outer loop (24) and an inner loop (25).

The string (22) is passed behind the outer loop (24) and between the outer loop (24) and the inner loop (25) as is shown in FIGS. 3 and 6. The extreme outer end (26) of the clip structure (23) is bent outwardly as can best be seen in FIG. 6, to facilitate easy positioning of the string (22) to the position shown in FIGS. 1–3 and 6. This clip (23) can be attached directly to the handle (12) in many ways. For example a threaded fastener (27) can be utilized to attach the clip (24) having a washer (28) between the fastener (27) and the clip (23) directly to a bow handle. But since a large percentage of commercially available bows today have a pressure button attached thereto by a threaded member (29) on one side of the handle, it is convenient to attach the clip (23) to such a structure by a bracket (30) having an opening (31) in one end thereof and a threaded opening in the other end thereof. A threaded fastener (27) can be tightly, threadably engaged in such opening in the other end of bracket (30).

In order to set up the bow (10) with the string tracking apparatus installed thereto, the arrow (18) would be nocked onto the string. The bow (10) is then laid down on a flat surface, on the side being viewed in FIG. 1. A broadhead (32) on the arrow (18) would then be loosened, since it is of a type which is threadably attached to the front end of the arrow shaft (18). About three feet of string (22) is then removed from the spool (33), and the end of the string (22) is looped around the portion of the broadhead (32) as shown in FIG. 4. The string (22) can also be looped around the shaft or arrow (18), as shown in FIG. 1, to keep it close to the shaft (18) if desired. Then the broadhead (32) is tightened down in the fashion shown in FIG. 5, wherein the string (22) is securely and frictionally engaged between the broadhead (32) and the shaft (18). The excess part of the string (22) is then attached to the clip (23) as shown in FIGS. 1–3 and 6 so that the string (22) is held close to the arrow (18) and close to the bow handle (12) to prevent the string from coming loose from the spindle (22) or otherwise becoming tangled on tree limbs or brush or the like. Then, when the arrow (18) is shot from the bow (10), the string (22) is pulled from the clip (23) and unwinds from the outside of the spool of string (33) so that the string (22) extends from the present location of the arrow after it is shot back to the spool of string (33). Assuming the arrow passes into or through a game animal, the string will flow off of the outside of the spool of string (33) as the animal retreats. Then the string can be followed to locate such fatally hit game animal.

Alternatively, the slot (34) in housing (20) can be made narrow to the extent that it acts as a clip to prevent string (22) from unwinding prematurely off of the outside of the spool full of string (33); or a separate clip can be attached to the housing (20) to prevent the spool of string (33) from prematurely unwinding prior to the shooting of arrow (18) from the bow (10).

Obviously many modifications and variations of the present invention are possible in light of the above teachings. It is therefore to be understood that, within the scope of the appended claims, the invention may be practiced otherwise than as specifically described.

I claim:

1. In combination, a bow, an arrow, a string, a string storage means for attaching said string to said bow, means for attaching one end of the string to the forward end of said arrrow, and:

clip means attached to said bow for preventing said string from prematurely unwinding from said string storage means, wherein said clip means is attached to said bow generally adjacent to the arrow, and at a point spaced from and above said string storage means, for holding a portion of the string intermediate the string storage means and said clip means close to the bow and arrow; wherein, the one end of the string that is attached to the forward end of an arrow will have a minumum amount of slack string between the forward end of the arrow and the clip means, prior to the bow being drawn; and, the amount of slack string will increase as the bow is drawn, only between the forward end of the arrow and the clip means which is mounted on the bow.

2. The combination of claim 1; wherein said clip means comprises:

a length of wire having an outer loop and an inner loop.

3. The combination of claim 2; wherein said outer loop of wire is bent outwardly relative to said inner loop.

4. The combination of claim 2; wherein said clip means further comprises:

a bracket having an opening in one end and a threaded opening in the other end; and, a threaded fastener for securing said length of wire to said other end.

* * * * *